US005268010A

United States Patent [19]

Zengerer

[11] Patent Number: 5,268,010

[45] Date of Patent: Dec. 7, 1993

[54] VACUUM CLEANER

[76] Inventor: Hans Zengerer, Brunnenweg 6, Wildon, Austria

[21] Appl. No.: 910,313

[22] PCT Filed: Jan. 16, 1991

[86] PCT No.: PCT/AT91/00009

§ 371 Date: Jul. 16, 1992

§ 102(e) Date: Jul. 16, 1992

[87] PCT Pub. No.: WO85/00117

PCT Pub. Date: Jan. 17, 1985

[30] Foreign Application Priority Data

Jan. 17, 1990 [AT] Austria ..... A 87/90

[51] Int. Cl.[5] ..... B01D 47/02

[52] U.S. Cl. ..... 55/245; 55/248; 55/255

[58] Field of Search ..... 55/248, 250, 255, 256, 55/244, 245

[56] References Cited

U.S. PATENT DOCUMENTS

| | | | |
|---|---|---|---|
| 852,543 | 5/1907 | Deckebach | 55/255 |
| 1,964,794 | 7/1934 | Gilbert | 55/255 |
| 2,143,188 | 1/1939 | Coulter | 55/256 |
| 2,164,833 | 7/1939 | Norman | 55/255 |
| 2,468,934 | 5/1949 | Kleyn | 261/123 |

FOREIGN PATENT DOCUMENTS

| | | | |
|---|---|---|---|
| 372426 | 5/1932 | United Kingdom | 55/248 |
| 32508 | 5/1934 | United Kingdom . | |

*Primary Examiner*—Charles Hart

*Attorney, Agent, or Firm*—Salter, Michaelson & Benson

[57] ABSTRACT

The Vacuum Cleaner features a vacuum chamber (3), in which a negative pressure is generated by a blower (6), and an liquid container (4) arranged underneath vacuum chamber. The vacuum chamber (3) is separated from the liquid container (4) by a partition (19) with an aperture in the center, which is shielded by a cover (21). A suction line (9) leads to the bottom of the liquid container (4). It transports the dust into the liquid container (4), where it is bound by water. To tranquilize the turbulences developing in the liquid, lamellae (11) are arranged transverse to the suction line (9) in staggered position to each other and extending only over part of the cross section of the vacuum chamber (4). This configuration as well as the arrangement of the cover (21) prevent liquid particles from being swept along into the vacuum chamber (3).

13 Claims, 1 Drawing Sheet

VACUUM CLEANER

Figure 1:
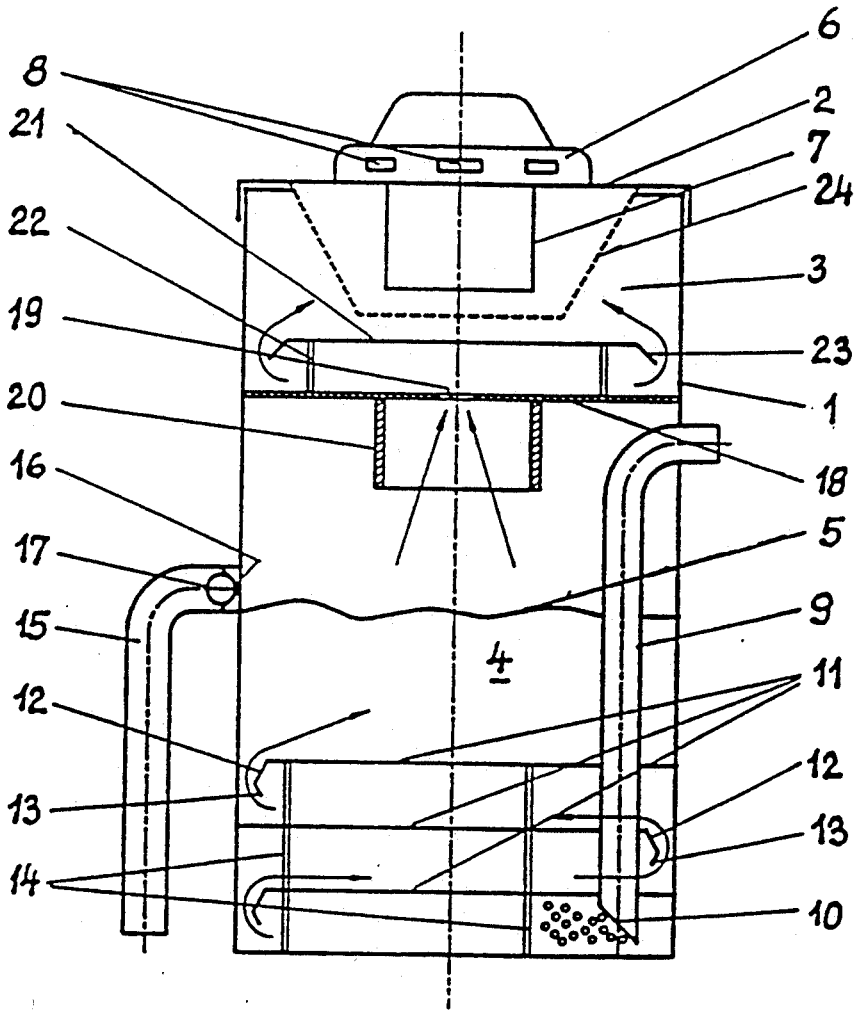

The subject matter of the invention is a Vacuum Cleaner which features a vacuum chamber, a motor-driven blower, which generates a negative pressure in the vacuum chamber, and whose aspiration port leads into the vacuum chamber, and a suction line for the dust, which is connected with the vacuum chamber.

Vacuum cleaners of this design exist in numerous versions. Due to the negative pressure produced by the blower in the vacuum chamber, dust is drawn into the vaccum chamber via the suction line. To prevent the dust from escaping again through the air-outlet openings of the blower, the vacuum chamber must be provided with a filter, normally a filter bag, to retain the dust. In conventional vacuum cleaners, this filter is made either of textile fabric, bonded fiber fabric for example, or air-permeable paper. It is absolutely necessary that the filter be permeable to air as otherwise the blower cannot produce the negative pressure in the filter chamber. A certain air throughput through the filter must be ensured; otherwise the negative pressure would be too small, and the motor which propels the blower would not be sufficiently cooled by the air supplied by the blower and become liable to damage. The consequence would be that fine dust particles are drawn through the filter and, via the air-outlet openings of the blower, hurled back into the room from which the dust should be removed by the vacuum cleaner. This drawback cannot be eliminated, not even by arrangement of several filters one after the other as featured by some vacuum cleaners. Especially viruses and bacteria are not retained by the filter of conventional vacuum cleaners, but escape back into the room to be cleaned, where they are mixed with the air leaving the air-outlet openings of the blower, so that the employment of conventional vacuum cleaners may be rather detrimental, especially in areas such as hospitals. The use of conventional vacuum cleaners may be particularly harmful in rooms occupied by people suffering from dust allergies as well as in rooms in which computer installations are accommodated.

The invention presented aims at eliminating the disadvantages of conventional vacuum cleaners and at creating a Vacuum Cleaner in which practically the entire dust drawn up via the suction line is kept back, so that no small particles can escape through the air-outlet openings of the blower. To solve this problem, the inventor proposes to place a liquid container beneath the vacuum chamber that is connected with the latter, to run the suction line from its end on the bottom of the liquid container upward, and to provide, above the end of the suction line in the liquid container, lamellae that are arranged transverse to the upward suction line and extend only over a part of the cross section of the liquid container, with adjacent lamellae partly overlapping each other.

Designing the Vacuum Cleaner according to this invention results in the advantage that the dust drawn up via the suction line is transported into a liquid bath where; it is mixed with the liquid and finally settles on the bottom of the liquid container in the form of sludge. The same happens with fine dust particles as well as bacteria, viruses and the like, which are bound in the liquid and cannot be returned into the room to be cleaned.

By the negative pressure, which exists in the vacuum chamber, a natural current of air is generated in the liquid so that the dust is drawn up via the suction line entering the liquid container, and at the same time turbulences are created in the liquid. The lamellae contained in the liquid container act now as a turbulence brake for the liquid and prevent the liquid from being carried along by the current of air and from entering the vacuum chamber located above the liquid level and from there, via the aspiration port of the blower, into the blower and the air-cooled blower motor, and from being hurled back into the room to be cleaned. Due to the lamellae configuration, the air flows mainly in parallel direction to them, i.e. mainly horizontal, with the flow path being considerably prolonged by the arrangement of the lamella. Air bubbles which rise vertically in the liquid and cause the turbulences in the liquid are crushed by the lamella walls, so that the liquid is tranquilized.

For functional reasons, neighboring lamellae are fastened on opposite positions on the wall of the liquid container, so that the air has to travel a long, meandering path in the liquid, and complete tranquilization of the liquid is ensured.

This effect can be enhanced by another feature of this invention, which is to provide the free edges of the lamellae with a downward-protruding shoulders that also cause the air bubbles to burst. Optimal results are achieved if the lower end of the shoulder is bent back in the direction of the fastening point of the lamella, so that a movement of the air bubbles by dodging the lower end of the shoulder is largely prevented.

Arrangement of a sufficient number of lamellae ensures that the air flowing through the liquid container does not draw along any liquid particles into the vacuum chamber which might get into the blower or the blower motor. Nevertheless it may be useful to take further precautions to prevent liquid particles from being carried along into the vacuum chamber. To this end, the invention features, on the upper end of the liquid container, a partition which extends all over its cross section and is provided with an aperture, preferably in the center, into the vacuum chamber. From the partition, a connecting piece, which surrounds the aperture and is preferably cylindrical in shape, extends downward, i.e. in the direction to the liquid container. This configuration too prevents any liquid particles from being swept along into the vacuum chamber, because any liquid particles that might have been carried along are kept back by the partition. To also retain any liquid particles that might have been carried along through the aperture of the partition, the invention features a cover above the aperture placed at some distance from the partition and fastened preferably by means of spacers. For practical reasons the edge of the cover is bent downward so that the liquid film which develops on the cover is held back.

In compliance with another feature of the invention, an overflow opening equipped with a safety valve is provided above the topmost lamella, through which excess liquid can escape if, for example, the liquid level rises in the liquid container due to accumulation of dust sludge on the bottom.

Should it be desirable that the air leaving the air-outlet openings of the blower be completely dry, which, however, is not necessary, liquid contained in any mist in the vacuum chamber can be removed by covering the aspiration port of the blower with an air-permeable water trap. This water trap may be made of textile fabric, paper or a fine-meshed metal screen.

The blower is preferably mounted in the lid of the vacuum chamber, and the aspiration port is formed by a tubular piece running in the direction of the aperture in the partition, which also prevents the entry of any liquid particles into the blower or the blower motor.

The liquid to be employed can be simply water but also any other liquid, for example disinfection liquid, which kills bacteria, viruses, etc. It is also possible to add disinfectants and/or odorous substances; in the latter case a pleasant scent can be created in the room to be cleaned. Even an anti-freeze can be added to the water to prevent it from freezing if the Vacuum Cleaner according to this invention is used at low temperatures, for example outdoors during winter time.

The Vacuum Cleaner according to this invention may not only be used to clean rooms but also for the removal of dust produced during cutting and grinding operations, for example of stone or rock. During such operations, for example by cutting rock by means of a cutting wheel or a saw blade, considerable quantities of dust are produced, which clog the filters of the above-mentioned conventional vacuum cleaners in a very short time so that the air throughput through the filter is obstructed and the vacuum cleaner becomes ineffective.

The drawing illustrates schematically the invention in a design version. It shows the cross section of a Vacuum Cleaner according to this invention.

The Vacuum Cleaner according to this invention preferably has a cylinder-shaped casing 1, whose top end is covered by a lid 2. The lid 2 is connected air-tight to the casing 1 in the conventional way, which is not described in more detail.

The upper part of the casing 1 houses a vacuum chamber 3, a liquid container 4, which contains a liquid, especially water, is arranged in the lower part of the casing 1. The liquid level is indicated by 5.

In the vacuum chamber 3, a negative pressure is generated via a motor-driven blower 6 arranged in the lid. Its aspiration port, which leads into vacuum chamber 3 is surrounded by a tubular piece 7. On the exterior of the lid it is provided with air-outlet openings 8.

An upward leading suction line 9, whose end 10 is placed on the bottom of the liquid container 4, is placed in the liquid container. The top end of this suction line 10, which protrudes from the casing 1, is connected to the hose of the Vacuum Cleaner in the conventional way not described here. Above the end 10 of the suction line 9 several parallel lamellae 11 are arranged transverse to the suction line 9 and to each other as well as to the bottom of the casing 1. Neighboring lamellae are fastened onto the respective opposite sides of the wall of the liquid container in such a way that they partly overlap each other. The free edges of the lamellae 11 are provided with downward-protruding shoulders 12, whose ends are bent backward in the direction of the fastening point at 13. The lamellae are additionally supported by spacers 14.

The above described arrangement and design of the lamellae produces an air flow in the liquid container 4 as indicated by the arrows; air bubbles contained in the liquid are crushed, and liquid particles are prevented from being carried along to the top.

An overflow pipe 15 leads into the liquid container 4 above the liquid level. Its overflow opening is provided with a safety valve 17, which opens if the liquid level 5 rises in the liquid container 4 so that part of the liquid can be discharged via the overflow pipe 15.

The liquid container 4 is separated from the vacuum chamber 3 by a partition 18 with an aperture 19 in its center. From this partition 18, a cylinder-shaped connecting piece 20, which surrounds the aperture at some distance, extends downward. A cover 21 is provided above the aperture. It is connected to the partition 18 by means of spacers 22. The edge (23) of the cover 21 is bent downward.

The piece 7 is surrounded by a water trap 24, which is connected to the lid 2 and is exchangeable. It may consist of air-permeable textile fabric or paper or of a fine-meshed metal screen.

If a negative pressure is created in the vacuum chamber 3 by the blower 6, a negative pressure is produced also in the liquid container 4 and the liquid contained in it, since the vacuum chamber 3 is connected to the liquid container 4 via the aperture 19. Due to this negative pressure, the dust is drawn up via the suction line 9. This dust mixes with the liquid, is bound by it, and then settles on the bottom of the liquid container in the form of sludge, which must be removed from time to time, just as conventional vacuum cleaners must be emptied. The liquid container 4 needs only to be emptied and rinsed.

The accumulation of sludge in the liquid container 4 raises the liquid level 5. An excessive rise is prevented by installation of the overflow pipe 15 with a safety valve 17.

the arrangement of the Lamellae 11, the partition 18 with the cylinder-shaped connecting piece 20 surrounding the aperture 21, the piece 7, and the water trap 24 ensure that no liquid particles can get into the blower or its drive motor and via the air-outlet openings 8 into the open.

The design of the Vacuum Cleaner according to this invention enables practically the complete separation of even finest dust particles as well as of any bacteria, viruses and the like.

I claim:

1. A vacuum cleaner comprising:

a vacuum chamber;

a liquid chamber having an outer wall, said liquid chamber being disposed beneath said vacuum chamber and being connected therewith;

a motor-driven blower having an aspiration port which extends into said vacuum chamber and generates a negative pressure in said vacuum chamber;

a suction line having a terminal end which extends into said liquid chamber, said terminal end being disposed adjacent a bottom end of said liquid chamber, said suction line extending upwardly from said bottom end of said liquid chamber; and a plurality of lamellae arranged in said liquid chamber above the terminal end of said suction line, said lamellae extending transverse to said suction line and extending only over a part of a cross-section of said liquid chamber so that the terminal edges of said lamellae are in spaced relation to the outer wall of said liquid chamber and so that adjacent lamellae at least partly overlap each other, each of said lamellae including a shoulder portion which extends downwardly from the terminal edge thereof.

2. In the vacuum cleaner of claim 1, said adjacent lamellae being fastened to opposite portions of said outer wall so that the shoulder portion on the terminal edges of said lamellae lie opposite to each other.

3. In the vacuum cleaner of claim 1, said shoulder portion being downwardly bent.

4. In the vacuum cleaner of claim 1, said liquid chamber including a partition at a top end thereof, said partition extending across the entire cross-section of said liquid chamber, said partition including a central aperture which leads into said vacuum chamber.

5. A vacuum cleaner comprising:

a vacuum chamber;

a liquid chamber having an outer wall and a partition at a top end thereof, said liquid chamber being disposed beneath said vacuum chamber and being connected therewith, said partition extending across the entire cross-section of said liquid chamber, said partition including a central aperture which leads into said vacuum chamber, and a substantially cylindrical collar which surrounds said aperture, said collar extending downwardly from said partition;

a motor-driven blower having an aspiration port which extends into said vacuum chamber and generates a negative pressure in said vacuum chamber;

a suction line having a terminal end which extends into said liquid chamber, said terminal end being disposed adjacent a bottom end of said liquid chamber, said suction line extending upwardly from said bottom end of said liquid chamber; and a plurality of lamellae arranged in said liquid chamber above the terminal end of said suction line, said lamellae extending transverse to said suction line and extending only over a part of a cross-section of said liquid chamber so that the terminal edges of said lamellae are in spaced relation to the outer wall of said liquid chamber and so that adjacent lamellae at least partly overlap each other, each of said lamellae including a downwardly bent shoulder portion which extends downwardly from the terminal edge thereof, said adjacent lamellae further being fastened to opposite portions of said outer wall so that the shoulder portion on the terminal edges of said lamellae lie opposite to each other.

6. In the vacuum cleaner of claim 5, said collar portion being spaced a predetermined distance from the peripheral edge of said aperture.

7. A vacuum cleaner comprising:

a vacuum chamber;

a liquid chamber having an outer wall and a partition at a top end thereof, said liquid chamber being disposed beneath said vacuum chamber and being connected therewith, said partition including a central aperture which leads into said vacuum chamber;

a cover which is fastened in spaced relation to said partition;

a motor-driven blower having an aspiration port which extends into said vacuum chamber and generates a negative pressure in said vacuum chamber;

a suction line having a terminal end which extends into said liquid chamber, said terminal end being disposed adjacent a bottom end of said liquid chamber, said suction line extending upwardly from said bottom end of said liquid chamber; and a plurality of lamellae arranged in said liquid chamber above the terminal end of said suction line, said lamellae extending transverse to said suction line and extending only over a part of a cross-section of said liquid chamber so that the terminal edges of said lamellae are in spaced relation to the outer wall of said liquid chamber and so that adjacent lamellae at least partly overlap each other, each of said lamellae including a downwardly bent shoulder portion which extends downwardly from the terminal edge thereof, said adjacent lamellae further being fastened to opposite portions of said outer wall so that the shoulder portion on the terminal edges of said lamellae lie opposite to each other.

8. In the vacuum cleaner of claim 7, said cover having a peripheral edge which is bent downwardly.

9. The vacuum cleaner of claim 1 further comprising an overflow opening in the outer wall of said liquid chamber above an uppermost lamellae, said overflow opening including a safety valve.

10. The vacuum cleaner of claim 1 further comprising an air-permeable water trap which surrounds the aspiration port of said blower.

11. In the vacuum cleaner of claim 10, said water trap comprising a material which is selected from the group consisting of a textile fabric, paper and fine-meshed metal screen.

12. In the vacuum cleaner of claim 4, said vacuum chamber having a lid, said blower being arranged in said lid, said aspiration portion comprising a tubular pipe which is axially aligned with the aperture in the partition.

13. In the vacuum cleaner of claim 1, said lamellae being impermeable to air and liquid.

* * * * *